US008112018B2

(12) United States Patent
Yoon et al.

(10) Patent No.: US 8,112,018 B2
(45) Date of Patent: Feb. 7, 2012

(54) DEVELOPING UNIT AND AN IMAGE FORMING APPARATUS

(75) Inventors: Hyung-won Yoon, Seoul (KR); Seung-yoon Lee, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 69 days.

(21) Appl. No.: 12/834,784

(22) Filed: Jul. 12, 2010

(65) Prior Publication Data

US 2010/0290816 A1 Nov. 18, 2010

Related U.S. Application Data

(63) Continuation of application No. 11/390,348, filed on Mar. 28, 2006, now abandoned.

(30) Foreign Application Priority Data

Sep. 12, 2005 (KR) ..... 10-2005-0084853

(51) Int. Cl.
*G03G 15/08* (2006.01)

(52) U.S. Cl. ..... 399/256; 399/284

(58) Field of Classification Search ..... 399/284, 399/256

See application file for complete search history.

(56) References Cited

U.S. PATENT DOCUMENTS

| | | | | |
|---|---|---|---|---|
| 4,161,923 | A * | 7/1979 | Abbott et al. | 399/275 |
| 5,012,286 | A | 4/1991 | Kawano et al. | |
| 5,355,199 | A * | 10/1994 | Bray | 399/256 |
| 5,499,082 | A | 3/1996 | Watanabe et al. | |
| 5,579,094 | A | 11/1996 | Behe et al. | |
| 5,594,198 | A | 1/1997 | Ikeda et al. | |
| 6,249,664 | B1 * | 6/2001 | Sato | 399/256 |
| 7,333,753 | B2 | 2/2008 | Hart et al. | |
| 2002/0122677 | A1 | 9/2002 | Noda et al. | |
| 2002/0186988 | A1 | 12/2002 | Abramsohn | |
| 2005/0123312 | A1 | 6/2005 | Mabuchi | |

FOREIGN PATENT DOCUMENTS

| | | |
|---|---|---|
| CN | 1612067 | 5/2005 |
| JP | 04-115268 | 4/1992 |
| JP | 04-285978 | 10/1992 |
| JP | 10-010853 | 1/1998 |
| JP | 11-133746 | 5/1999 |
| JP | 11-160988 | 6/1999 |
| JP | 2001-356592 | 12/2001 |
| JP | 2003-131490 | 5/2003 |

* cited by examiner

*Primary Examiner* — David Gray
*Assistant Examiner* — Erika J Villaluna
(74) *Attorney, Agent, or Firm* — Roylance, Abrams, Berdo & Goodman, L.L.P.

(57) ABSTRACT

A developing unit includes a developing unit body having a toner inlet and a developing roller mounted in the developing unit body. A toner feeding unit for feeding is provided to feed the toner from the toner inlet to the developing roller. A doctor blade is integrally formed with the developing unit body for controlling the thickness of the toner supplied to the developing roller.

16 Claims, 2 Drawing Sheets

DEVELOPING UNIT AND AN IMAGE FORMING APPARATUS

CROSS-REFERENCE TO RELATED APPLICATION

This application is a continuation application and claims the benefit under 35 USC §120 of U.S. Ser. No. 11/390,348 filed Mar. 28, 2006 now abandoned which is hereby incorporated by reference in its entirety. This application also claims the benefit of Korean Patent Application No. 2005-84853 filed on Sep. 12, 2005, in the Korean Intellectual Property Office, the disclosure of which is hereby incorporated by reference in its entirety.

BACKGROUND OF THE INVENTION

1. Field of the Invention

The present invention relates to an image forming apparatus. More particularly, the present invention relates to an improved developing unit for use in an image forming apparatus capable of developing an image by attaching a developer directly to an electrostatic latent image formed on an image carrying medium. The invention is also directed to an image forming apparatus including the developing unit.

2. Description of the Related Art

Conventional image forming apparatuses such as a laser printer, a laser emitting diode (LED) printer, a digital copier, and a general paper facsimile, perform the printing function by transferring an image signal in accordance with an input digital signal onto a printing medium in the form of a visible image.

Such image forming apparatuses include the image carrying medium, a developing unit, a laser scanning unit, and a fixing unit.

The image carrying medium is rotatably mounted in a main body of the image forming apparatus. An electrostatic latent image is formed on a surface of the image carrying medium by a laser beam projected from the laser scanning unit. The electrostatic latent image is visualized by toner supplied through the developing unit. Generally, the toner used herein has a predetermined color and electric property. The fixing unit fuses on the printing medium the visible toner image formed on the image carrying medium which is then transferred onto the printing medium by applying heat and pressure.

The developing unit comprises a developing unit body, a developing roller mounted in the developing unit body to supply the toner to the image carrying medium, a toner supplying roller, and an auger. The developing roller applies the toner supplied into the developing unit body to the electrostatic latent image by a predetermined thickness. Control of the toner thickness is provided by the developing unit body having a doctor blade for controlling the thickness of the toner layer supplied to the surface of the developing roller. The toner supplying roller and the auger supply the developing roller with the toner supplied to the developing unit body.

The above-structured developing unit is usually provided as a separate part from the image carrying medium and therefore has a relatively long lifespan since it can be used until the developing roller expires. Accordingly, a detachable toner cartridge has been suggested to refill the toner by replacing the toner cartridge. The auger and the toner supplying roller continuously supply the toner from the toner cartridge to the developing roller.

In the above-structured developing unit, however, a dedicated support member is required for mounting of the doctor blade to the developing unit body, thereby increasing the whole size of the developing unit.

In addition, in the conventional developing unit as described above, the toner may not be evenly supplied along the length of the developing roller. The toner can be concentrated and condensed at both ends of the toner supplying roller. When the condensed toner is supplied to the image carrying medium, quality of a finally printed image deteriorates.

SUMMARY OF THE INVENTION

An aspect of the present invention is to overcome the above problems and/or disadvantages. The invention also provides advantages that are not found in the prior devices as discussed hereinafter. Accordingly, an aspect of the present invention is to provide a developing unit having a simplified structured and an improved toner supply. The invention is further directed to an image forming apparatus including the developing unit of the invention.

In order to achieve the above-described aspects of the present invention, a developing unit is provided comprising a developing unit body having a toner inlet; a developing roller mounted in the developing unit body; a toner feeding unit for feeding charged toner through the toner inlet to the developing roller; and a doctor blade controlling thickness of the toner supplied to the developing roller, wherein the doctor blade is integrally formed with the developing unit body.

The developing unit body comprises a main frame for receiving the developing roller and the toner feeding unit, and has an open upper surface. The developing body also includes a cover frame covering the upper surface of the main frame and having a doctor blade.

The main frame and the doctor blade are formed of metal and attached to each other by welding.

The toner feeding unit comprises a toner supplying roller for supplying the toner to the developing roller; a pair of augers circulating the toner supplied to the developing unit body through the toner supplying roller; and a toner feeding member for feeding the charged toner through the toner inlet to one of the augers.

The toner feeding member includes a toner feeding belt running in association with one of the augers.

The developing unit body further comprises a protruded rib formed on a bottom and a ceiling thereof, respectively, to separate the pair of augers from each other and thereby form a toner circulation path.

The protruded ribs are integrally formed with the developing unit body.

Another aspect of the present invention is to provide an image forming apparatus comprising an image carrying medium mounted in a main body of the image forming apparatus; a developing unit for developing an electrostatic latent image by attaching developer to an area corresponding to the electrostatic latent image formed on the image carrying medium; a transfer unit for transferring the image developed on the image carrying medium onto a printing medium; and a fixing unit for fixing the transferred image on the printing medium. The developing unit comprises a developing unit body having a toner inlet; a developing roller mounted in the developing unit body; a toner feeding unit for feeding toner through the toner inlet to the developing roller; and a doctor blade for controlling thickness of the toner supplied to the developing roller and integrally formed with the developing unit body.

These and other features of the invention will become more apparent from the following detailed description of the invention in conjunction with the annexed drawings which disclose various embodiments of the invention.

BRIEF DESCRIPTION OF THE DRAWINGS

The above aspects and other features of the present invention will become more apparent by the detailed description of the exemplary embodiments thereof with reference to the attached drawing figures, wherein.

DETAILED DESCRIPTION OF THE EXEMPLARY EMBODIMENTS

Figure 1:
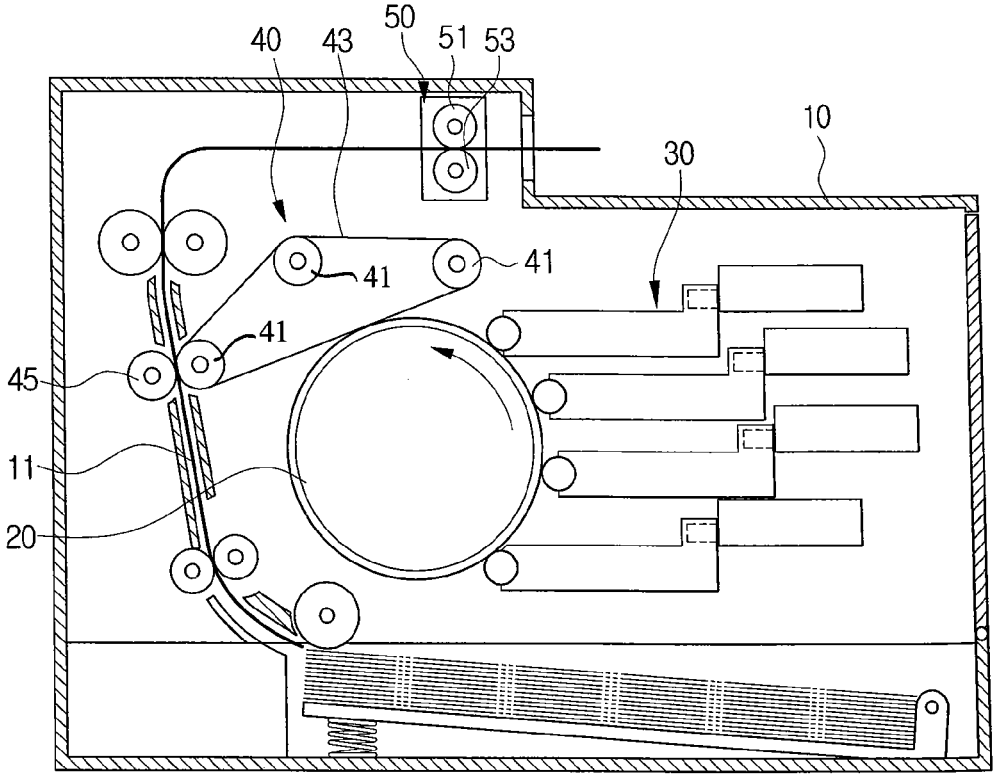
FIG. 1 is a schematic view showing an image forming apparatus according to an embodiment of the present invention.

Hereinafter, an embodiment of the present invention will be described in detail with reference to the accompanying drawing figures.

In the following description, same drawing reference numerals are used for the same elements in the different drawings. The matters defined in the description such as a detailed construction and elements are provided to assist in a comprehensive understanding of the invention but are not intended to limit the scope of the invention. Thus, it is apparent that the present invention can be carried out without those defined matters. Also, well-known functions or constructions are not described in detail since they would obscure the invention in unnecessary detail.

Referring to FIG. 1, an image forming apparatus according to an embodiment of the present invention, for producing a color image, comprises a main body 10, an image carrying medium 20 mounted in the main body 10. A plurality of developing units 30 attaching a developer to the image carrying medium 20 are provided. A transfer unit 40 for transferring an image formed on the image carrying medium 20 to a printing medium 11 is positioned adjacent the image carrying medium 20. A fixing unit 50 for fixing the transferred image on the printing medium 11 by applying heat and pressure is positioned downstream of the transfer unit 40.

A surface of the image carrying medium 20 is electrified to a predetermined potential by a charging unit (not shown) as known in the art. An electrostatic latent image corresponding to each color image is formed on the surface of the image carrying medium 20 through a laser beam projected by a laser scanning unit (not shown).

The plurality of developing units 30 sequentially attach color toners (black, cyan, magenta, and yellow) on the image carrying medium 20.

The transfer unit 40 comprises a transfer belt 43 supported by a plurality of support rollers 41. The transfer belt 43 moves along a caterpillar track defined by the rollers 41 and receive the color image from the surface of the image carrying medium 20. The belt 43 contacts the image carrying medium 20 and the printing medium 11 and transfers the color image onto the printing medium 11 that is passing between and in contact with a transfer roller 45 and the belt 43.

The fixing unit 50 comprises a heating roller 51 and a pressing roller 53 to fix the toner image transferred onto the printing medium 11 by applying heat and pressure. After passing through the fixing unit 50, the printing medium 11 is discharged to the outside of the main body 10 with the image fixed thereon.

Figure 2:
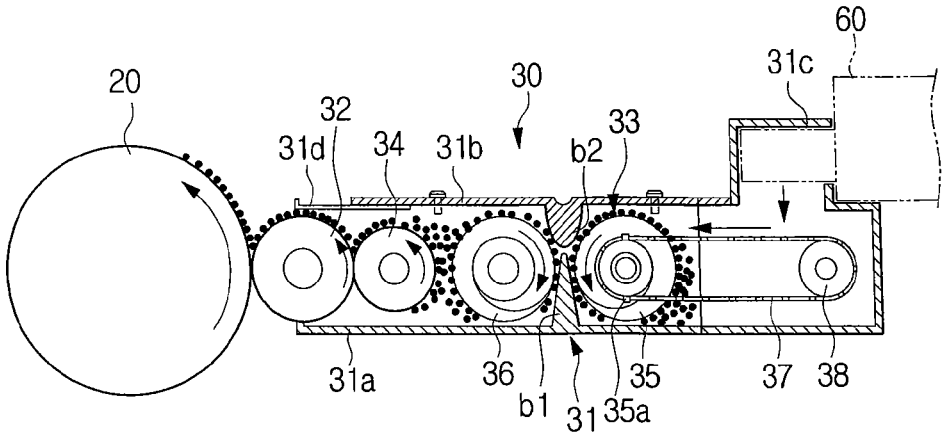
FIG. 2 is a cross-sectional side view of the image forming apparatus according to an embodiment of the present invention.
Figure 3:
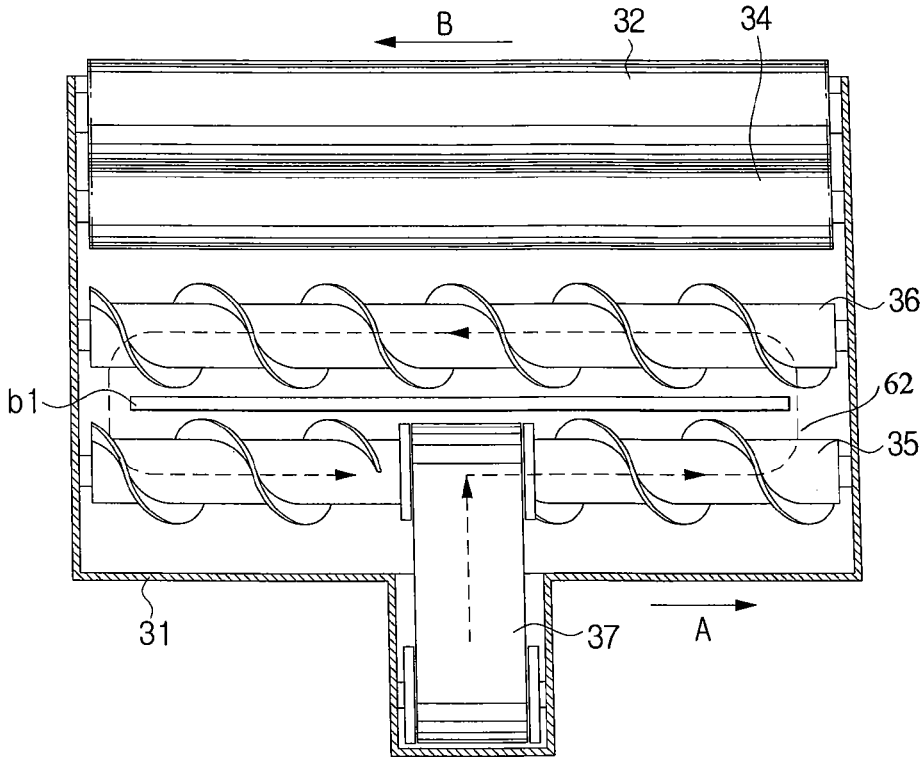
FIG. 3 is a cross-sectional top view of the image forming apparatus of FIG. 2.

As shown in FIGS. 2 and 3, the developing unit 30 comprises a developing unit body 31, a developing roller 32 rotatably mounted to the developing unit body 31, and a toner feeding unit 33 for moving the toner supplied from a toner cartridge 60 to the developing roller 32.

The developing unit body 31 comprises a main frame 31*a* accommodating the developing roller 32 and the toner feeding unit 33. A cover frame 31*b* is connected to an upper end of the main frame 31*a* to close the body 31. A toner inlet 31*c* directs the toner from the toner cartridge 60 to the toner feeding unit 33. The main frame 31*a* is preferably formed from molded plastic. The upper part of the main frame 31*a* has an open top end and closed by the cover frame 31. A first protruding rib b1 is formed on a bottom of the main frame 31*a* by a predetermined height and is positioned between augers 35, 36 of the feeding unit 33. The first protruding rib b1 has a height that is shorter than the diameter of the developing roller 32 as shown in FIG. 2.

The cover frame 31*b* is provided with a doctor blade 31*d* contacting the developing roller 32 for controlling the thickness of the toner supplied onto the surface of the developing roller 32. The doctor blade 31*d* extends from an end of the cover frame 31*b* to an upper surface of the developing roller 32 opposite the bottom portion of the main frame 31*a*. The cover frame 31*b* is connected to the main frame 31*a* by a fastening member such as a bolt to cover the upper part of the main frame 31*a*. The cover frame 31*b* may be formed of metal. Preferably, the doctor blade 31*d* is also formed of metal and attached to the cover frame 31*b* by welding. It will be understood that the cover frame 31*b* and the doctor blade 31*d* may be formed as an integrated unit made of metal. The doctor blade 31*d* is typically a thin resilient plate that is able to form a substantially uniform layer of toner on the developing roller 31*d*.

The developing roller 32 is mounted to rotate in the vicinity of the image carrying medium 20 with a predetermined developing gap formed between the developing roller 32 and the image carrying medium 20. While rotating, the developing roller 32 rotates with respect to the image carrying medium 20 to transfer the toner to the developing roller 32 to a predetermined thickness.

A second protruding rib b2 having a predetermined height extends downward from a lower surface of the cover frame 31*b* toward and opposing the first protruding rib b1. The protruding ribs b1 and b2 are positioned between and separate augers 35 and 36 from each other, as described in detail hereinafter, to improve the flow of the toner.

The toner inlet 31*c* is formed at the upper end of the developing unit body 31. The toner cartridge 60 is mounted to the toner inlet 31*c* for supplying the toner to the developing unit 30.

The toner feeding unit 33 comprises a toner supplying roller 34 mounted within the developing unit body 31, first and second augers 35 and 36, and a toner feeding member 37.

The toner supplying roller 34 is rotatably mounted in the vicinity of the developing roller 32. The toner supplying roller 34 carries the toner supplied by the first and the second augers 35 and 36, to the developing roller 32.

The first and the second augers 35 and 36 are arranged parallel with the toner supplying roller 34 and rotate in opposite directions to each other. By rotation of the first and the second augers 35 and 36 in the opposite directions with the protruded ribs b1 and b2 interposed therebetween, the toner fed by the toner feeding member 37 is circulated along the toner circulation path formed by the augers 35 and 36 and supplied to the toner supplying roller 34. The first auger 35 moves the toner fed from the toner feeding member 37 in a direction indicated by arrow A shown in FIG. 3. The toner being moved along the direction A is supplied to one end of the second auger 36. The second auger 36 moves the toner delivered from the first auger 35, in an opposite direction indicated by arrow B as shown in FIG. 3. A portion of the toner moving in the direction B is supplied to the developing roller 32 by the toner supplying roller 34. The remaining portion of the toner that is not supplied to the developing roller 32, is returned to the first auger 35 and re-circulated together with new toner supplied by the feeding member 37. In the embodiment shown, the feeding member 37 is a belt.

As shown in FIGS. 2 and 3, the first rib b1 and the second rib b2 are positioned to oppose each other and define a gap therebetween to allow a limited amount of the toner to pass between the augers. The ribs b1 and b2 as shown in FIG. 3 have a length less than the width of the body 31. The ends of the ribs b1 and b2 are spaced from the side walls so that rotation of the augers enables the toner particles to flow in a substantially continuous path indicated by the arrow 62 in FIG. 3.

The first and the second protruded ribs b1 and b2 between the first and the second augers 35 and 36 enable the toner circulation path between the first and the second augers 35 and 36 to be clearly defined between the two augers 35 and 36. Therefore, the toner is prevented from directly moving from the supply inlet 31*c* to the toner supplying roller 34 in a path transverse to the directions A and B. As a result, concentration and condensation of the toner at both ends of the toner supplying roller 34 can also be prevented.

The toner feeding member 37 comprises a feeding belt running along the length of the developing unit body 31. The feeding belt is supported by the first auger 35 and a supporting roller 38 to move the toner charged through the toner inlet 31*c* to the first auger 35. The feeding belt is rotated by the auger 35 and guided by guide protrusions 35*a* formed on the first auger 35.

In the above developing unit 30, the first and the second augers 35 and 36 are associated with the toner supplying roller 34 through a gear. The augers 35 and 36, and the toner supplying roller 34 are rotated by power transmitted from the developing roller 32.

The operation of the image forming apparatus having the above configuration according to an embodiment of the present invention will now be described.

First, a predetermined color image is formed on the image carrying medium 20 by the charging unit, the laser scanning unit, and the developing units 30. The color image formed on the image carrying medium 20 is transferred onto the transfer belt 43. The color image on the transfer belt 43 is then transferred onto the printing medium 11 being passed over the transfer roller 43. After being passed through the fixing rollers 51 53 of the fixing unit 50, the printing medium 11 is discharged from the main body 10.

During the above printing processes, the toner is supplied from the toner cartridge 60 into the developing unit body 31 by the developing unit 30. The supplied toner is moved to the first auger 35 by the toner feeding member 37, for example, the feeding belt. The first auger 35 supplies the toner to one end of the second auger 36 in the direction A. The second auger 36 supplied with the toner at one end by the first auger 35 moves the toner in the direction B. A portion of the toner being moved in the direction B is supplied to the developing roller 32 by the toner supplying roller 34. The remainder of the toner being moved in the direction B is carried by the second auger 36 and returned to the first auger 35. The first auger 35 carries the toner returning from the second auger 36 and the toner fed by the feeding belt in the direction A again and keeps circulating the toners.

As described above, since the first and the second augers 35 and 36 supply the toner to the toner supplying roller 34 while continuously circulating the toner, the toner can be evenly supplied onto the toner supplying roller 34 without being concentrated at certain parts of the toner supplying roller 34. In particular, by clearly defining the toner circulation path between the protruding ribs b1 and b2 formed between the first and the second augers 35 and 36, the toner is prevented from being directly moved from the inlet 31*c* to the toner supplying roller 34 at the middle part, thereby improving the flow of the toner. Accordingly, condensation and deterioration of the toner is reduced. Finally, the quality of the printed image can be improved.

According to the above description, the doctor blade 31*d* is attached to the cover frame by welding so as to also function as the cover. Therefore, a dedicated bracket is not required to provide a compact size of the developing unit.

As a result, in case of a color image forming apparatus comprising a plurality of the developing units, the whole size of the apparatus can be reduced.

In addition, by providing the protruding ribs directed toward each other between the main frame and the cover frame, the strength of the frames is increased and the toner circulation path can be clearly defined between the augers. Therefore, being circulated inside the developing unit body by the augers, the toner is prevented from concentrating at both ends of the toner supplying roller or deteriorated. As a result, electrification performance of the toner and deterioration of the image quality is prevented.

While the invention has been shown and described with reference to certain embodiments thereof, it will be understood by those skilled in the art that various changes in form and details may be made therein without departing from the spirit and scope of the invention as defined by the appended claims.

What is claimed is:

1. A developing unit comprising:

a developing unit body having a toner inlet, the developing unit body having a main frame with an open upper surface, and a cover frame coupled to the main frame and enclosing the open upper end of the main frame, the cover frame defining a top wall of the developing unit body, said main frame including a first rib extending upwardly from a bottom surface thereof, said cover frame having a second rib extending downwardly from a top surface thereof toward said first rib and spaced therefrom, said first and second ribs having a length less than a width of the developing body;

a developing roller mounted in the main frame of the developing unit body;

a toner feeding unit in the main frame for feeding toner charged through the toner inlet to the developing roller, the toner feeding unit including first and second spaced-apart augers, said first auger being on a first side of said ribs and said second auger being on a second side of said ribs, said ribs forming a circulation path between the augers;

a toner feeding belt coupled to a middle portion of the second auger for supplying toner from the inlet to the second auger, the toner feeding belt being driven by the second auger; and a doctor blade positioned for controlling thickness of the toner supplied to the developing roller and being integrally formed with the cover frame.

2. The developing unit of claim 1, wherein the cover frame and the doctor blade are formed of metal and attached to each other by welding.

3. The developing unit of claim 1, wherein the toner feeding unit comprises:

a toner supplying roller for supplying the toner to the developing roller; and a toner feeding member for feeding the toner from the toner inlet to one of the augers.

4. The developing unit of claim 3, wherein the toner feeding member includes a toner feeding belt operatively coupled to one of the augers for supplying toner to said augers, said feeding belt extending between said toner inlet and said augers for conveying toner from said inlet to said augers.

5. The developing unit of claim 4, wherein said feeding belt is coupled to a middle portion of one of said augers, and where the toner feeding belt is driven by said auger.

6. The developing unit of claim 1 wherein the main frame and the cover frame respectively comprise a protruding rib on a surface thereof directed toward each other to separate the pair of augers from each other and form the toner circulation path between the augers.

7. The developing unit of claim 1, wherein said cover frame is substantially planar having an end adjacent the developing roller and where the doctor blade extends from the end of the cover frame in a direction substantially parallel to the plane of the cover frame.

8. An image forming apparatus comprising:

an image carrying medium mounted in a main body of the image forming apparatus; a developing unit for developing an electrostatic latent image by attaching a developer to an area corresponding to the electrostatic latent image formed on the image carrying medium; a transfer unit for transferring the image developed on the image carrying medium onto a printing medium; and a fixing unit for fixing the transferred image on the printing medium, wherein the developing unit comprises, a developing unit body having a toner inlet, a main frame with an open upper surface and a first protruding rib formed on a bottom surface and a cover frame coupled to the main frame and enclosing the open upper surface of the main frame, the cover frame defining a top wall of the developing unit body and a second opposing protruding rib;

a developing roller mounted in the developing unit body;

a toner feeding unit for feeding toner from the toner inlet to the developing roller, the toner feeding unit including a pair of spaced-apart augers, said ribs being positioned between the augers and having a length less than a width of the main frame to form a circulation path between the augers, said second rib protruding downward from the top wall to extend between the augers; and a doctor blade integrally formed with the cover frame for controlling thickness of the toner supplied to the developing roller.

9. A developing unit , comprising:

a developing unit body having a toner inlet, the developing unit body having a main frame and a cover frame;

a developing roller mounted in the main frame of the developing unit body;

a toner feeding unit for feeding toner charged through the toner inlet to the developing roller;

wherein the developing unit body has a bottom wall with a first protruding rib having a length less than a length of said augers and a second protruding rib on a top surface and having a length less than the length of the augers to separate the pair of augers from each other and thereby form a toner circulation path between the augers.

10. The developing unit of claim 9, wherein the developing unit body has a main frame and a cover frame coupled to the main frame, and where the first protruding rib is integrally formed with the main frame and second protruding rib is integrally formed with the cover frame of the developing unit body.

11. The developing unit of claim 8, wherein said first rib has a top edge positioned at a height greater than a center axis of said first and second augers to define a gap between an upper portion of said augers.

12. The image forming apparatus of claim 8, wherein the cover frame and the doctor blade are formed of metal and attached to each other by welding.

13. The image forming apparatus of claim 8, wherein the toner feeding unit comprises:

a toner supplying roller supplying the toner to the developing roller; and a toner feeding member feeding the toner charged through the toner inlet to one of the augers.

14. The image forming apparatus of claim 13, wherein the toner feeding member includes a toner feeding belt extending between said toner inlet and said augers, and being operatively coupled to one of the augers for supplying toner through said toner inlet to said augers.

15. The image forming apparatus of claim 14, wherein said toner feeding belt is coupled to a middle portion of one of said augers, and where the toner feeding belt is driven by said auger.

16. The image forming apparatus of claim 13, wherein the first and second protruding ribs are integrally formed with the main frame and cover frame, respectively, and the developing unit body.

* * * * *